US010252434B2

(12) United States Patent
Lin

(10) Patent No.: US 10,252,434 B2
(45) Date of Patent: Apr. 9, 2019

(54) ROTARY TRIMMER DEVICE

(71) Applicant: Pao Shen Enterprises Co., Ltd., Chang Hua (TW)

(72) Inventor: Chen-Yu Lin, Chang Hua (TW)

(73) Assignee: Pao Shen Enterprises Co., Ltd., Chang Hua (TW)

( * ) Notice: Subject to any disclaimer, the term of this patent is extended or adjusted under 35 U.S.C. 154(b) by 99 days.

(21) Appl. No.: 15/449,171

(22) Filed: Mar. 3, 2017

(65) Prior Publication Data

US 2018/0141228 A1 May 24, 2018

(30) Foreign Application Priority Data

Nov. 22, 2016 (TW) ..... 105138230 A

(51) Int. Cl.

| | |
|---|---|
| ***B26D 5/02*** | (2006.01) |
| ***B26F 1/20*** | (2006.01) |
| ***B26D 1/18*** | (2006.01) |
| ***B26D 3/08*** | (2006.01) |

(52) U.S. Cl.

CPC ..... *B26D 1/185* (2013.01); *B26D 3/085* (2013.01); *B26D 5/02* (2013.01); *B26F 1/20* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 4,064,626 | A * | 12/1977 | Meshulam | B26B 5/005 | 30/287 |
| 4,590,834 | A * | 5/1986 | Sobel | B26D 3/02 | 83/455 |
| 4,685,366 | A * | 8/1987 | Beder | B26D 7/025 | 384/39 |
| 5,272,947 | A * | 12/1993 | Peters | B26D 7/2614 | 83/455 |
| 2003/0029291 | A1* | 2/2003 | Lin | B26D 3/10 | 83/620 |
| 2003/0182807 | A1* | 10/2003 | Lin | B23D 35/008 | 30/290 |
| 2004/0088952 | A1* | 5/2004 | Carlo | B26D 7/2614 | 53/520 |
| 2006/0053994 | A1* | 3/2006 | Carrillo | B26D 1/185 | 83/485 |

* cited by examiner

*Primary Examiner* — Sean M Michalski
*Assistant Examiner* — Fernando A Ayala
(74) *Attorney, Agent, or Firm* — Trop Pruner & Hu, P.C.

(57) ABSTRACT

A rotary trimmer device includes a rotary trimmer assembly slidably connected with a rail mounted on a base. The assembly includes a housing defining a lower inclined wall inclined relative to a working plane on which an object to be cut is placed, a blade holder coupled with and rotatable relative to the inclined wall and holding at least one cutting blade to shift the blade between cutting and non-cutting positions by rotation thereof, and a retaining unit disposed between the inclined wall and the blade holder.

10 Claims, 11 Drawing Sheets

ROTARY TRIMMER DEVICE

CROSS-REFERENCE TO RELATED APPLICATION

This application claims priority of Taiwanese Patent Application No. 105138230, filed on Nov. 22, 2016.

FIELD

The disclosure relates to a paper cutter, and more particularly to a rotary trimmer device.

BACKGROUND

Referring to FIG. 1, a conventional rotary trimmer device includes a base 1 and a rotary trimmer assembly 2. The base 1 has a base plate 11 with a bottom surface 111, and a rail 12. The rotary trimmer assembly 2 includes a housing 21 defining an accommodation space 211 therein, a slider 22 slidable on the rail 12 and partly accommodated in the accommodation space 211, a blade holder 23 movably connected to the slider 22 for pivotably holding a circular cutting blade 24, and a biasing member 25 interposed between the slider 22 and the blade holder 23. Pressing an upper portion 231 of the blade holder 23 to project a cutting edge of the cutting blade 24 downwardly of the bottom surface 111 and sliding the rotary trimmer assembly 2 along the rail 12, a paper cutting work is conducted. Such rotary trimmer device can make wavy cuts or perforations or just score the paper without cutting the same, with the use of various circular cutting blades. However, upon changing the blade, the cutting blade 24 should be removed from the blade holder 23 for replacement with a desired cutting blade 24 on the blade holder 23, which causes inconvenience to the user.

SUMMARY

Therefore, an object of the disclosure is to provide a rotary trimmer assembly that can alleviate at least one of the drawbacks of the prior art, and a rotary trimmer device having the rotary trimmer assembly.

According to the disclosure, the rotary trimmer assembly is used with a working plane, and includes a housing, a blade holder and a retaining unit. The housing has a top block which has a lower inclined wall facing and inclined relative to the working plane, and a surrounding wall which extends downwardly from a periphery of the top block and which cooperates with the lower inclined wall to define an accommodation space with a lower opening. The housing defines an axis which is normal to the lower inclined wall and which intersects the working plane by an acute angle. The blade holder is coupled with and is rotatable relative to the lower inclined wall about the axis. The blade holder has a holding seat which is accommodated in the accommodation space to be spaced apart from the lower inclined wall and which has at least one holding wall that is inclined relative to the axis, at least one cutting blade rotatably mounted on the holding wall, and an operating member which is disposed in the accommodation space, which surrounds the axis to have a handle portion projecting outwardly of the surrounding wall, and which is connected with the holding seat such that the cutting blade is shiftable, by rotation of the blade holder relative to the lower inclined wall about the axis, between a cutting position, where the cutting blade is adjacent to and extends vertically to the working plane and has a cutting edge projecting outwardly of the lower opening, and a non-cutting position, where the cutting blade is remote from and inclined to the working plane and is accommodated in the accommodation space. The retaining unit is disposed between the lower inclined wall and the holding seat, and has a spindle member which extends along the axis from the lower inclined wall such that the blade holder is sleeved rotatably around the spindle member, a retaining member which is interposed between the lower inclined wall and the holding seat and which is movable in a direction of the axis between a retaining position, where the lower inclined wall is retained to the holding seat to prevent rotation of the holding seat, and a non-retaining position, where the rotation of the holding seat is permitted, and a biasing member which is disposed to bias the retaining member to the retaining position.

According to the disclosure, the rotary trimmer device includes a base having the working plane and a rail extending over the working plane, and the rotary trimmer assembly. The rotary trimmer assembly is slidably connected with the rail. The top block of the housing has a penetrating hole configured to be fittingly engaged with the rail to permit the housing to be slidable on the rail.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
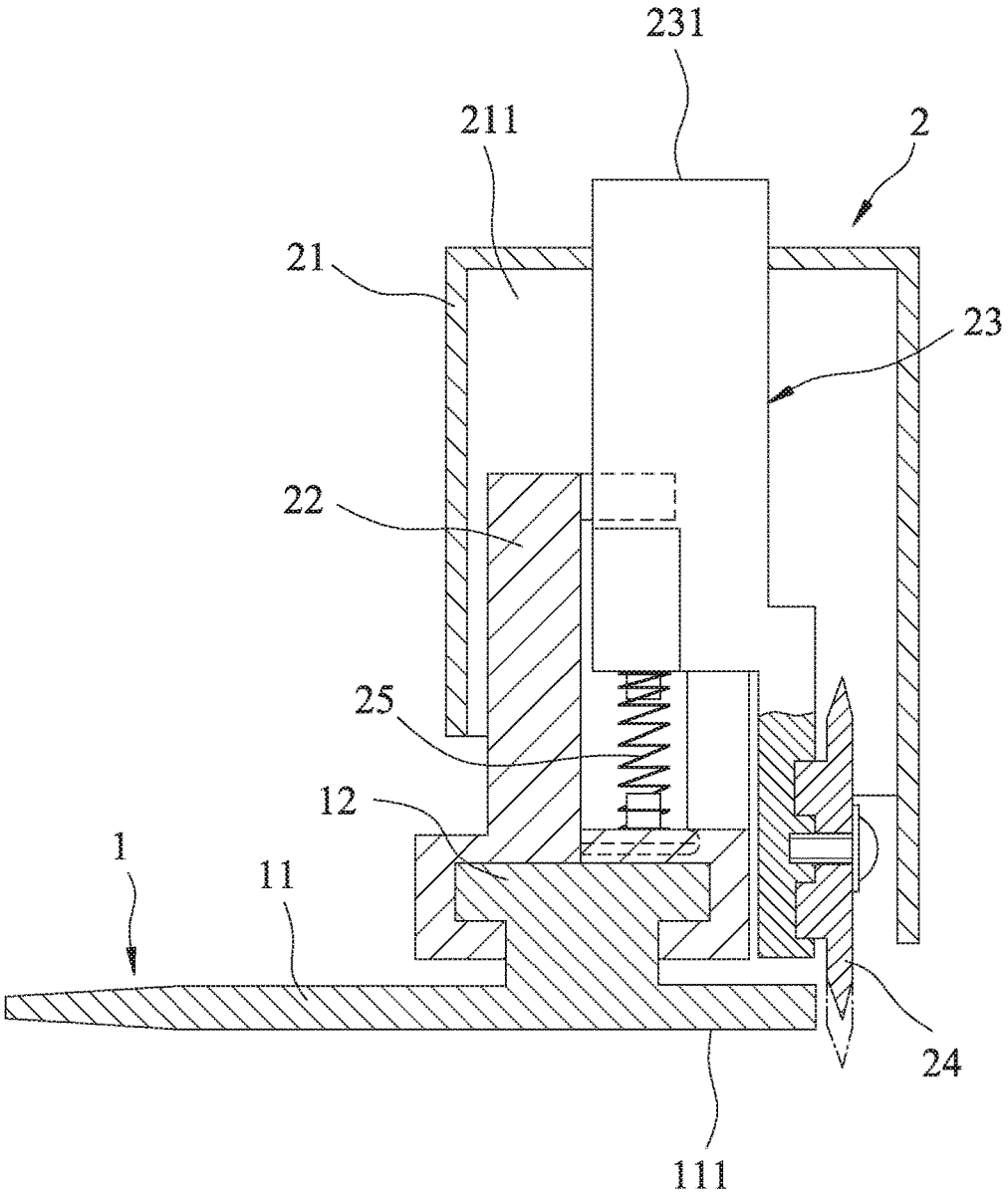
FIG.1 PRIOR ART
FIG. 1 is a schematic sectional view of a conventional rotary trimmer device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
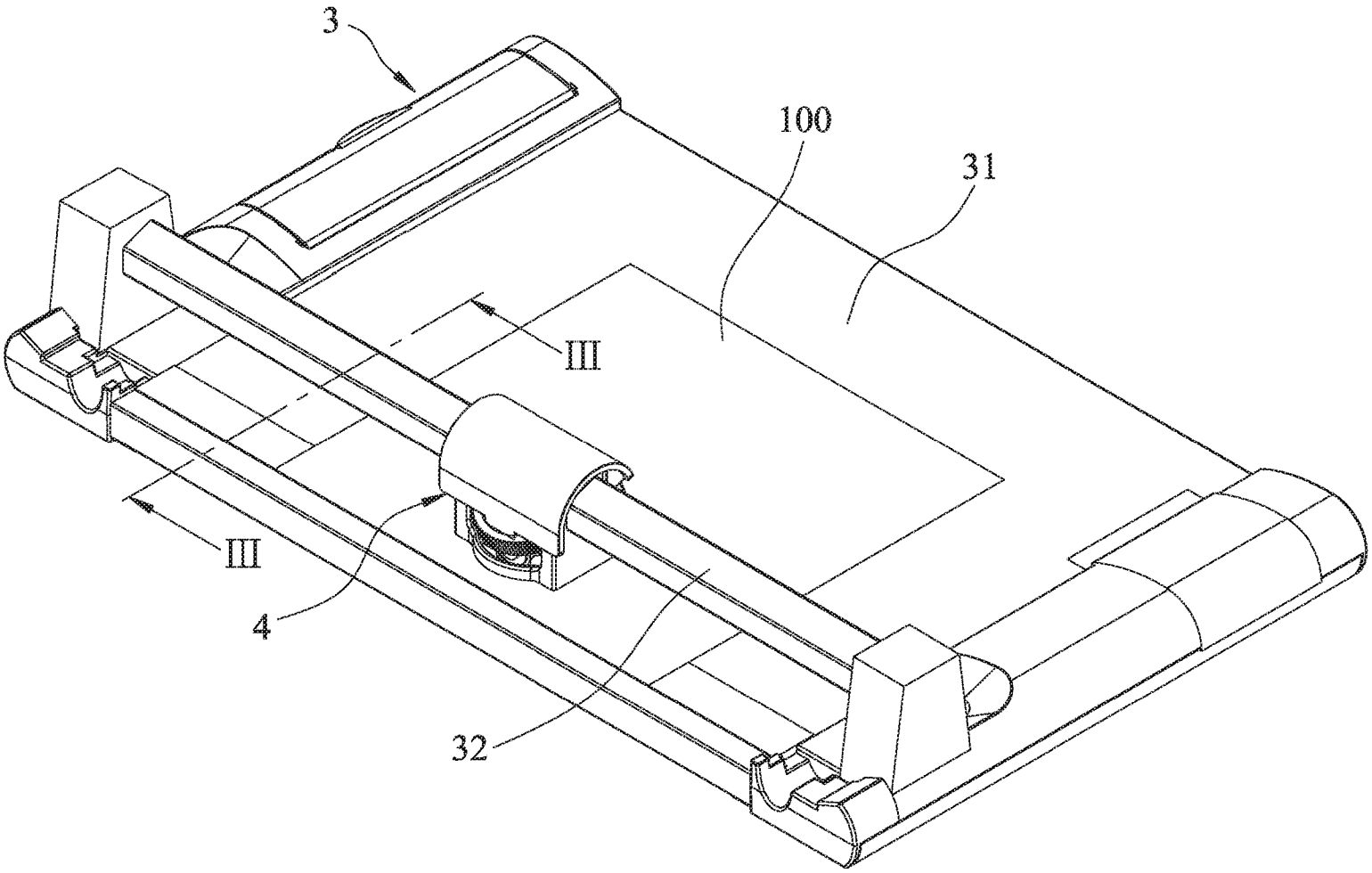
FIG. 2 is a perspective view of an embodiment of a rotary trimmer device according to the disclosure.
Figure 3:
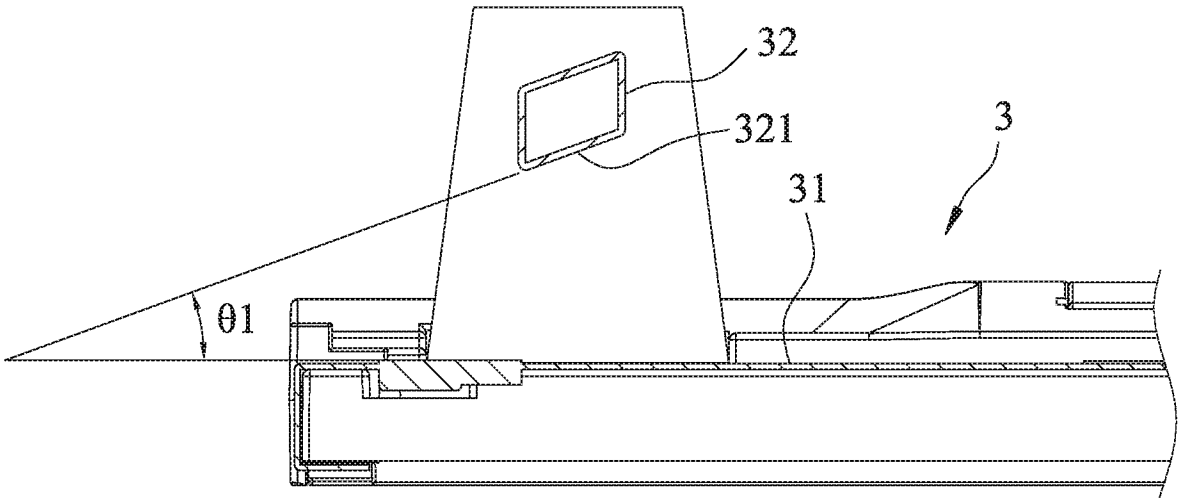
FIG. 3 is a fragmentary, partly sectional view illustrating a rail and a working plane of a base in the embodiment.
Figure 4:
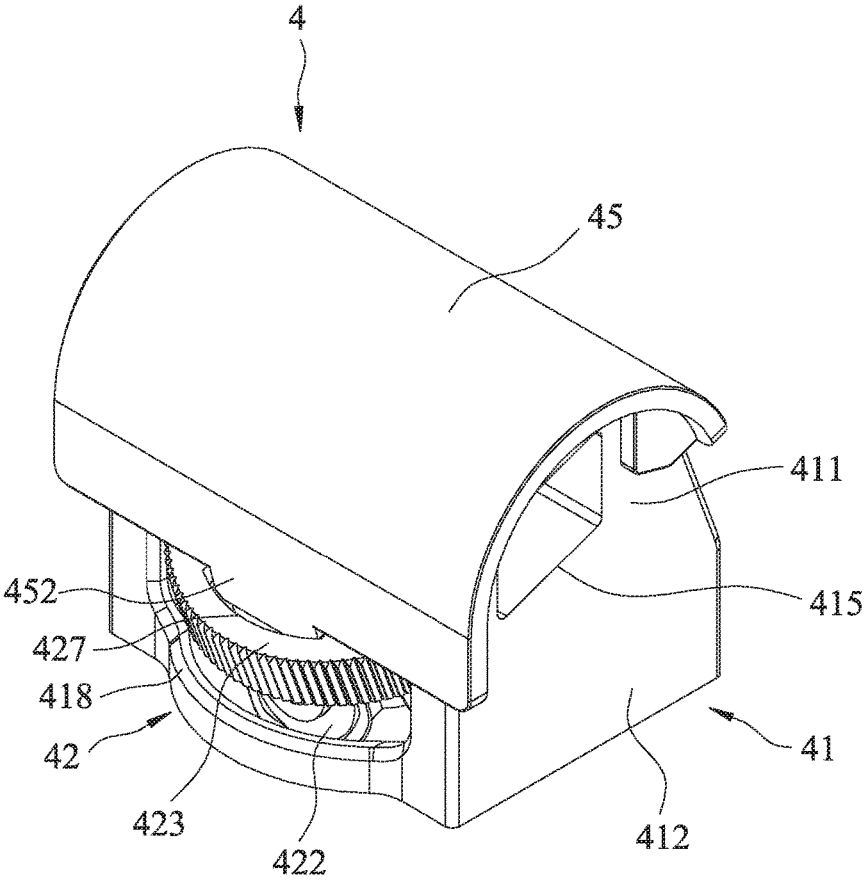
FIG. 4 is a perspective view illustrating a rotary trimmer assembly of the embodiment.

Referring to FIGS. 2 to 4, an embodiment of a rotary trimmer device according to this disclosure includes a base 3 and a rotary trimmer assembly 4.

The base 3 has a working plane 31 and a rail 32 extending over the working plane 31. The rail 32 has a cross-section of a parallelogram such that the rail 32 has a bottom wall 321 which intersects the working plane 31 by an acute angle (θ1).

Figure 5:
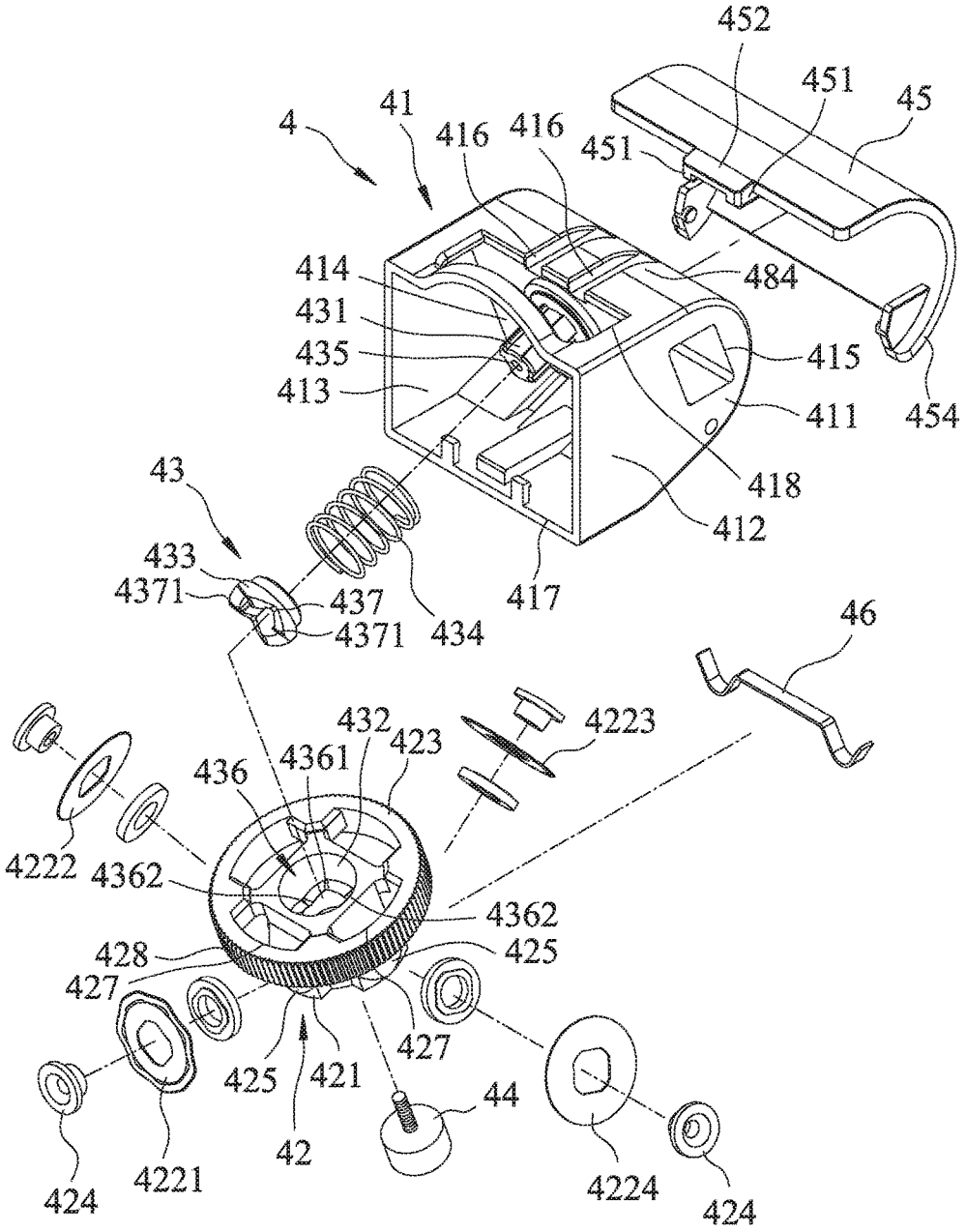
FIG. 5 is an exploded perspective view of the rotary trimmer assembly.
Figure 6:
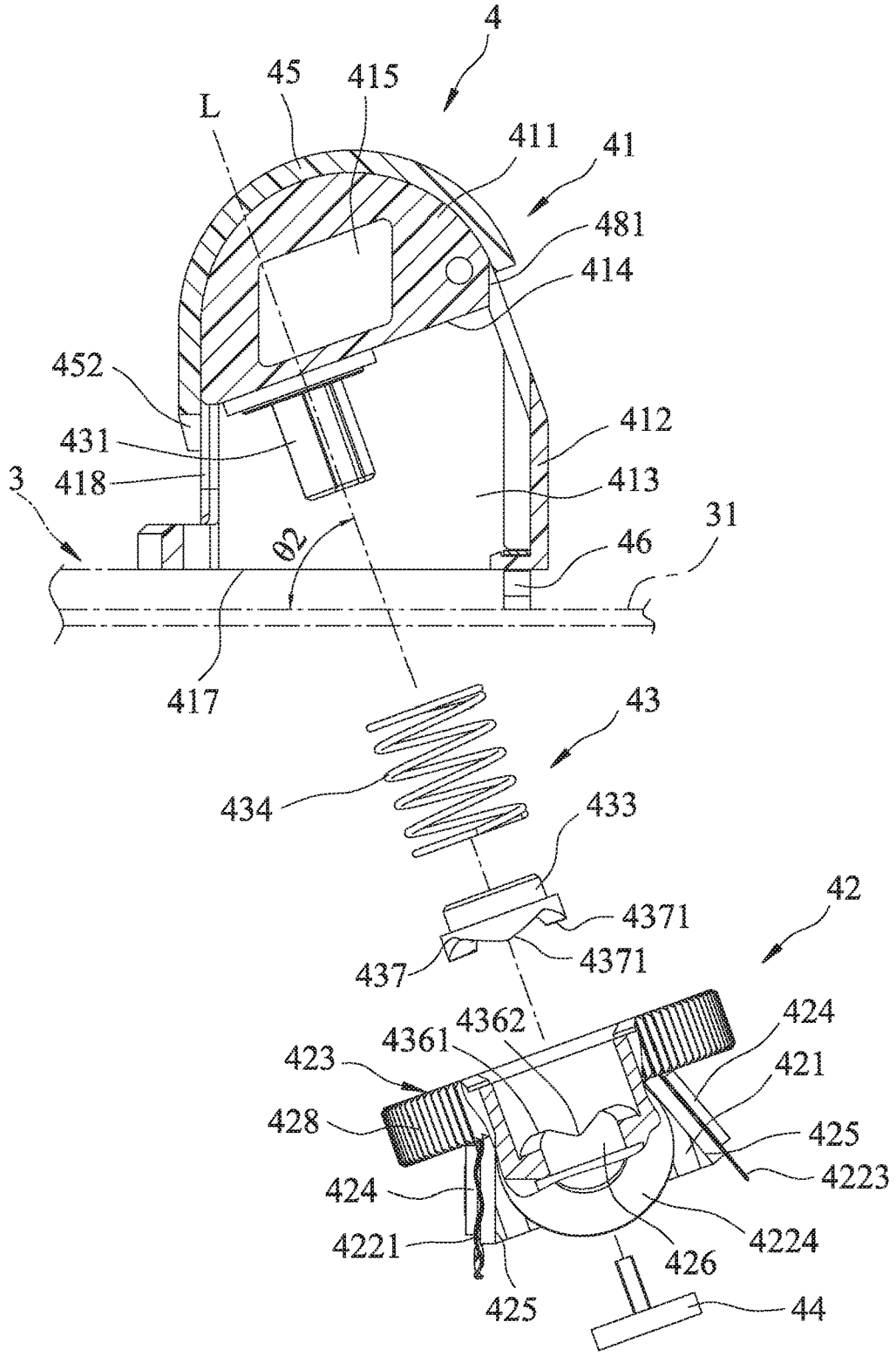
FIG. 6 is a fragmentary, partly sectioned and exploded view illustrating the rotary trimmer assembly.

Referring to FIGS. 2, 5 and 6, the rotary trimmer assembly 4 includes a housing 41, a blade holder 42, a retaining unit 43, a lock cap 45 and a stand leg 46.

The housing 41 has a top block 411 which has a lower inclined wall 414 facing and inclined relative to the working plane 31, and a surrounding wall 412 which extends downwardly from a periphery 481 of the top block 411 and which cooperates with the lower inclined wall 414 to define an accommodation space 413 with a lower opening 417. The top block 411 has a penetrating hole 415 configured to be fittingly engaged with the rail 32 to permit the housing 41 to be slidable on the rail 32. In this embodiment, the penetrating hole 415 is also of a parallelogram shape. The surrounding wall 412 has a lateral opening 418 formed therethrough. The top block 411 has two elongated grooves 416 formed in an outer surface 484 thereof and extending to communicate with the lateral opening 418.

Figure 7:
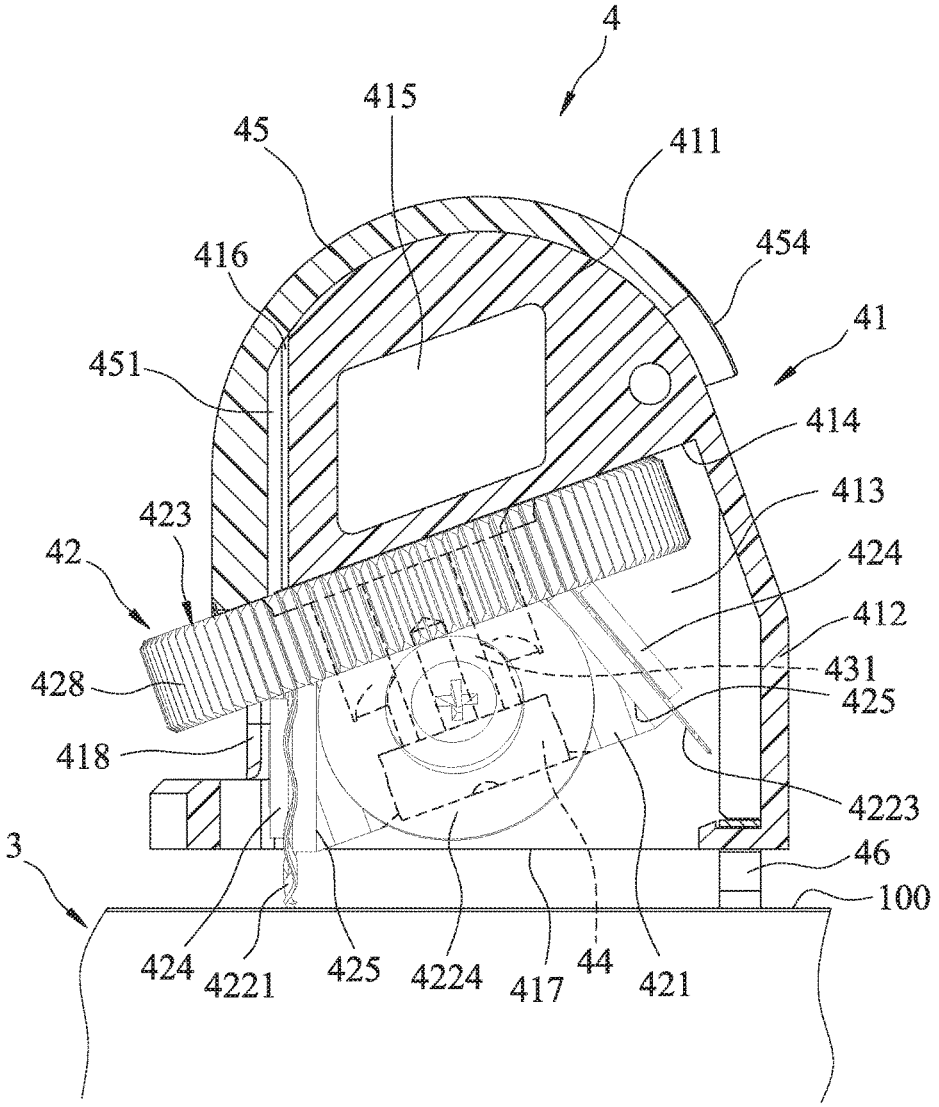
FIG. 7 is a fragmentary, partly sectional view illustrating a state when a cutting blade is in a cutting position and a lock cap is in a locking position.

Referring to FIGS. 5 to 7, the housing 41 defines an axis (L) which is normal to the lower inclined wall 414 and which intersects the working plane 31 by an acute angle (θ2). The blade holder 42 is coupled with and is rotatable relative to the lower inclined wall 414 about the axis (L). Specifically, the blade holder 42 has a holding seat 421 which is accommodated in the accommodation space 413 to be spaced apart from the lower inclined wall 414 and which has four holding walls 425 that are inclined relative to the axis (L) and that are angularly displaced from each other about the axis (L), four cutting blades 4221, 4222, 4223, 4224 which are respectively and rotatably mounted on the holding walls 425, and an operating member 423 which is disposed on the holding seat 421 in the accommodation space 413 and which surrounds the axis (L) to have a handle portion 428 projecting outwardly of the surrounding wall 412 of the housing 41 from the lateral opening 418. Each of the cutting blades 4221, 4222, 4223, 4224 is in a form of a wheel which is rotatably mounted on the respective holding wall 425 through a pivot member 424 and which has a rim serving as a cutting edge. The holding seat 421 is in a form of a frusto-square pyramid, and has a fastening hole 426 formed in a bottom wall 487 thereof and extending along the axis (L) (see FIG. 9). The operating member 423 has four upper lock holes 427 which are respectively formed above the holding walls 425 and which are opened upwardly. The handle portion 428 is in a form of a friction surface.

Figure 8:
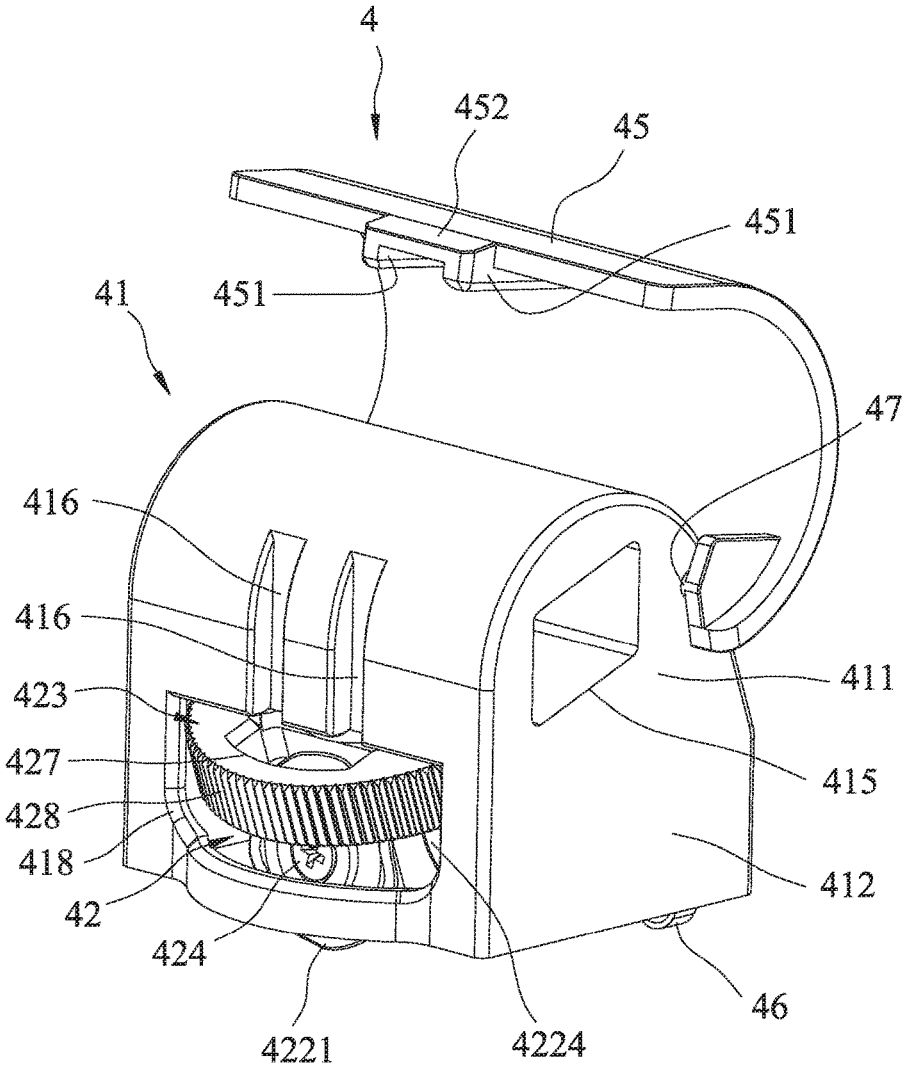
FIG. 8 is a perspective view illustrating a state when the lock cap is in an unlocking position.
Figure 9:
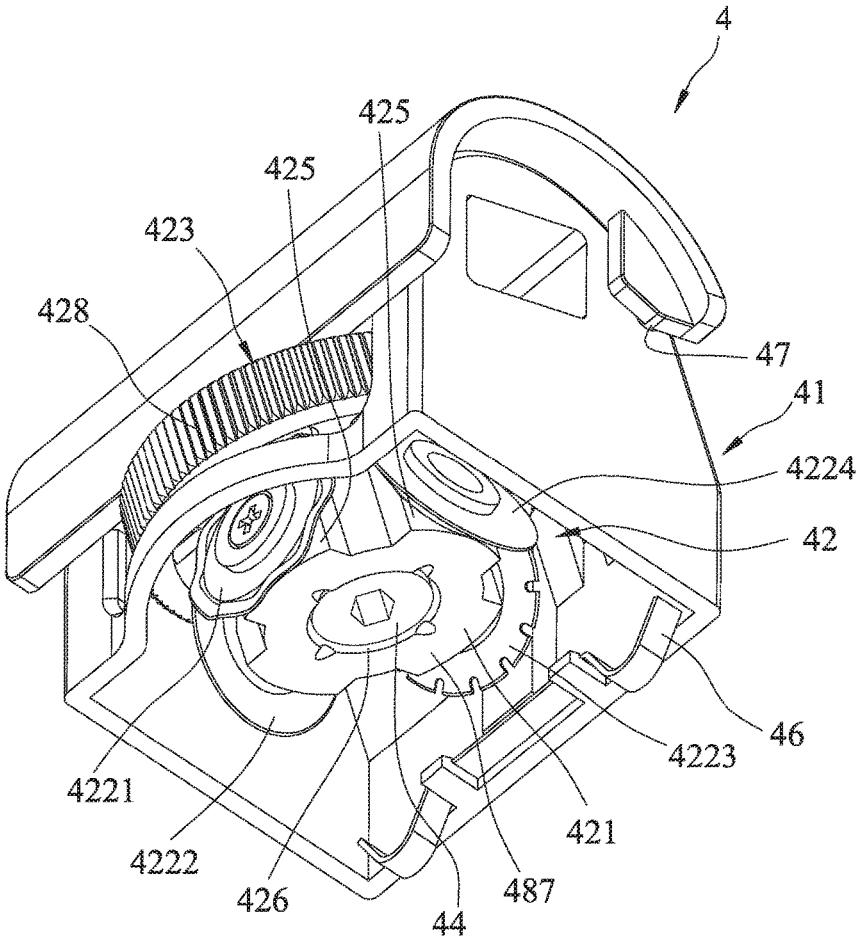
FIG. 9 is a perspective view taken in another angle.
Figure 10:
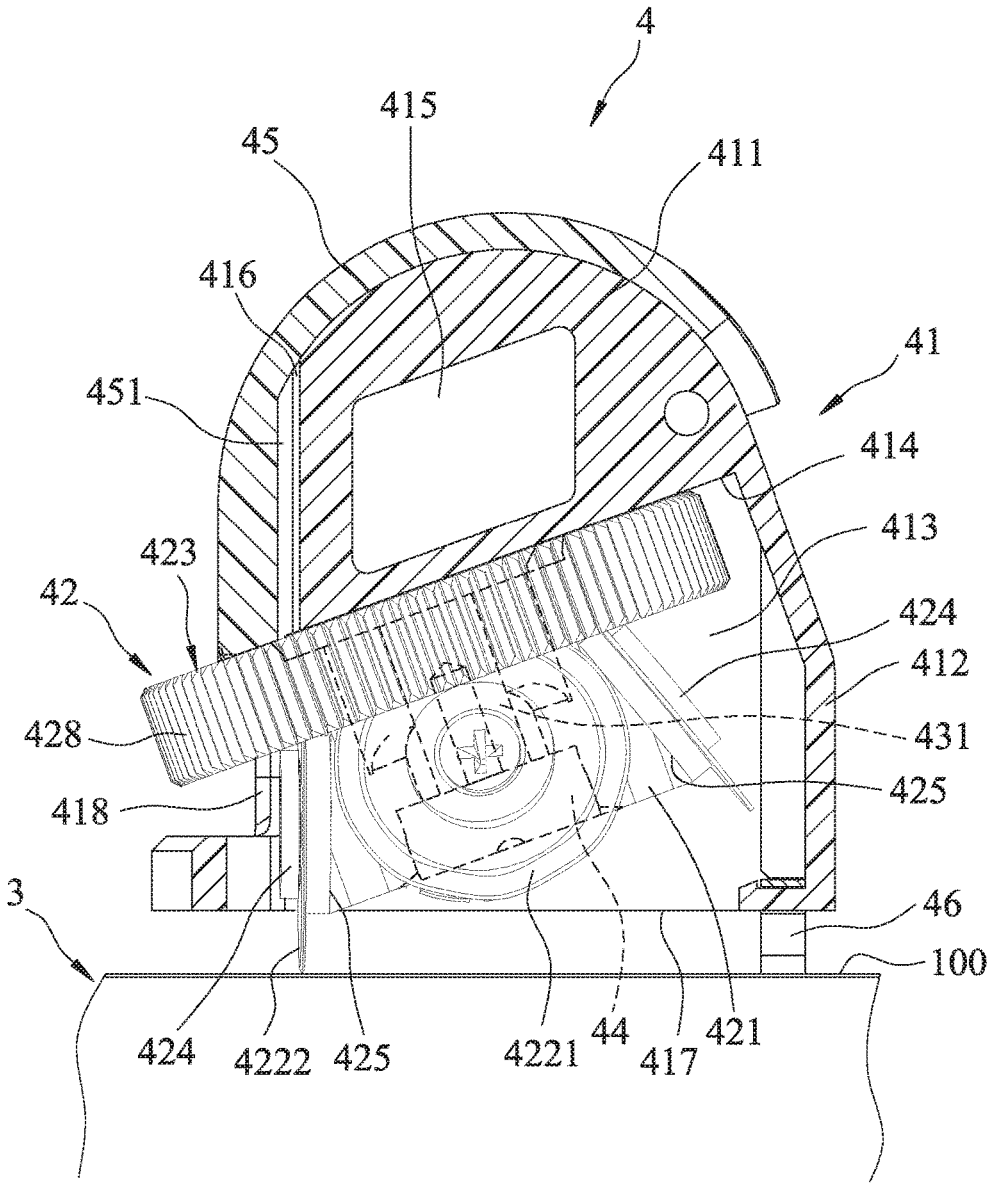
FIG. 10 is a view similar to FIG. 7, illustrating a state when another cutting blade is in a cutting position.

Referring to FIGS. 7 to 9, by manually operating the handle portion 428 of the operating member 423 to rotate the blade holder 42 about the axis (L), one of the cutting blades 4221, 4222, 4223, 4224 (the cutting blade 4221 is illustrated in the drawings as an example) is shiftable between a cutting position (as shown in FIG. 7), where the cutting blade 4221 is adjacent to and extends vertically to the working plane 31 and has its cutting edge projecting outwardly of the lower opening 417, and a non-cutting position (as shown in FIG. 10), where the cutting blade 4221 is remote from and inclined to the working plane 31 and is accommodated in the accommodation space 413. It can be appreciated that when one of the cutting blades 4221, 4222, 4223, 4224 is retained in the cutting position, three other ones of the cutting blades 4221, 4222, 4223, 4224 are in the non-cutting position.

Referring to FIGS. 5 and 6, the retaining unit 43 is disposed between the lower inclined wall 414 and the holding seat 421, and has a spindle member 431 which extends along the axis (L) from the lower inclined wall 414 such that the blade holder 42 is sleeved rotatably around the spindle member 431, and a retaining member 433 which is interposed between the lower inclined wall 414 and the holding seat 421 and which is in a spine engagement with the spindle member 431, i.e. not rotatable relative to the spindle member 431. The blade holder 42 has a recess 432 extending in a direction of the axis (L) for insertion of the spindle member 431 thereinto, and terminating at a retaining wall 4361 which faces the lower inclined wall 414 and which has a plurality of grooves 4362 (four grooves 4362 in this embodiment) that are angularly displaced from each other about the axis (L). The retaining member 433 has a retained wall 437 which has a plurality of teeth 4371 (four teeth 4371 in this embodiment) that are angularly displaced from each other about the axis (L) and that are disposed to be respectively engageable in the grooves 4362. Thus, the retaining member 433 is movable along the axis (L) between a retaining position, where the teeth 4371 are engaged in the grooves 4362 and the lower inclined wall 414 is retained to the blade holder 42 to prevent rotation of the holding seat 421 as well as the cutting blades, and a non-retaining position, where the rotation of the holding seat 421 is permitted. A biasing member 434 is sleeved around the spindle member 431 and disposed between the lower inclined wall 414 and the retaining member 433 to bias the retaining member 433 to the retaining position.

Moreover, the spindle member 431 has a female threaded portion 435. The retaining unit 43 further has a male threaded member 44 which is threadedly engaged with the female threaded portion 435 so as to keep the biasing member 434 and the retaining member 433 coaxial with each other along the axis (L).

Figure 11:
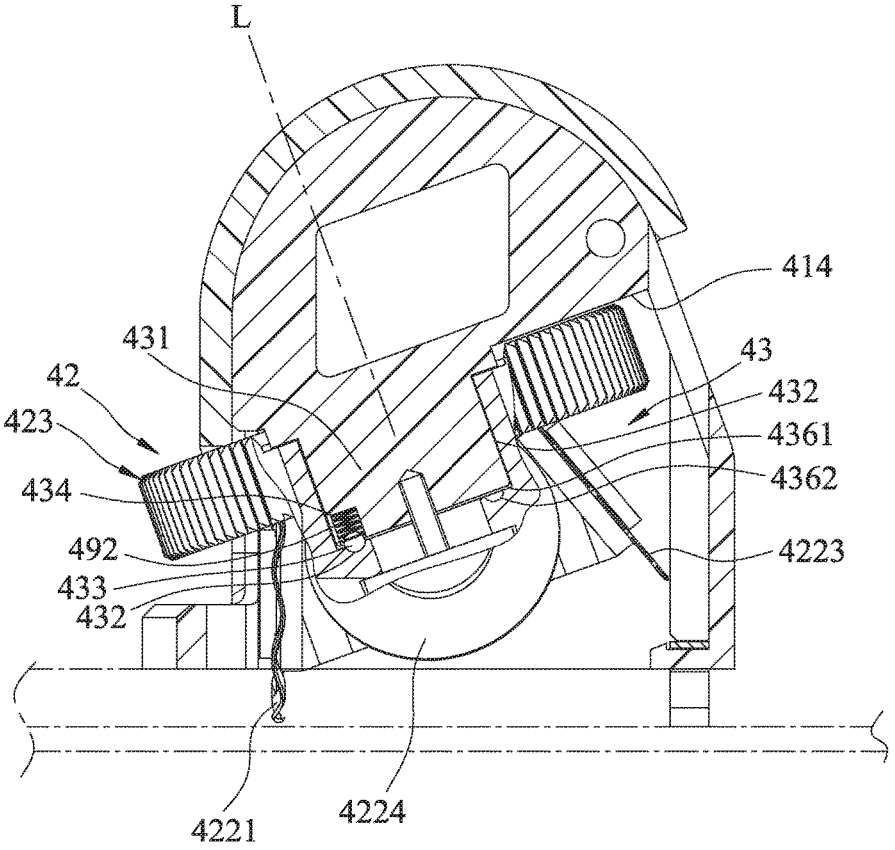
FIG. 11 is a fragmentary, partly sectional view illustrating another embodiment of the rotary trimmer assembly.

Referring to FIG. 11, alternatively, the retaining unit 43 may have a spindle member 431 extending downwardly from and integrally formed with the lower inclined wall 414, and having a concavity 492 for accommodating a biasing member 434 and a retaining member 433 therein. The blade holder 42 has a recess 432 for insertion of the spindle member 431 thereinto, and terminating at a retaining wall 4361 which has four grooves 4362 that are angularly displaced from each other about the axis (L). The retaining member 433 is in a form of a steel ball which is biased by a biasing action of the biasing member 434 to be engaged in a selected one of the grooves 4362 for reaching the retaining position.

Referring to FIGS. 4, 7 and 8, the lock cap 45 is pivotably connected to the top block 411 at a lateral end 454 thereof, and extends to cap the top block 411 and to terminate at a lock protrusion 452. The lock cap 45 has a pair of engaging ribs 451 formed on an inner wall and at two sides of the lock protrusion 452. Thus, the lock cap 45 is turnable between a locking position (as shown in FIGS. 4 and 7), where the engaging ribs 451 are respectively engaged in the elongated grooves 416 of the top block 411 and the lock protrusion 452 is retained in a selected one of the upper lock holes 427 so as to prevent the rotation of the blade holder 42, and an unlocking position (as shown in FIG. 8), where the lock cap 45 is remote from the top surface of the top block 411 to disengage the engaging ribs 451 from the elongated grooves 416 and to disengage the lock protrusion 452 from the upper lock hole 427 so as to permit the rotation of the blade holder 42.

The stand leg 46 is disposed on the surrounding wall 412 of the housing 41 at a side opposite to the handle portion 428 of the operating member 423. The stand leg 46 is disposed to stand on the working plane 31 so as to keep the lower inclined wall 414 intersecting the working plane 31 by the acute angle (θ2). Hence, a bottom of the cutting edge of the cutting blade 4221 in the cutting position and a bottom of the stand leg 46 are placed flush with each other on the working plane 31 for facilitating task of a cutting work.

Referring to FIGS. 2, 7, 9 and 10, during use, an object 100, such as paper, is placed on the working plane 31. By sliding the rotary trimmer assembly 4 along the rail 32, the object 100 can be cut by the cutting blade 4221 in the cutting position. To switch to the desired cutting blade, the lock cap 45 is turned to the unlocking position, the handle portion 428 is then turned to bring another cutting blade (such as the cutting blade 4222) into the cutting position, and the lock cap 45 is further returned to the locking position such that the blade holder 42 is prevented from rotation. The cutting blades 4221, 4222, 4223, 4224 may provide different cutting functions, such as making a straight cut, a wavy cut, making perforations, scoring the object without cutting, etc.

Referring to FIGS. 3, 6 and 7, in this embodiment, the bottom wall 321 of the rail 32 intersects the working plane 31 by an acute angle (θ1). The penetrating hole 415 of the top block 411 is of a parallelogram shape to be fittingly engaged with the rail 32 so as to permit the housing 41 to be slidable on the rail 32. As compared with a rail that has a bottom wall which is horizontal to a working plane, the average distance between the bottom wall 321 and the cutting blade 4221 in the cutting position is relatively short such that the required moment of a force applied to the rotary trimmer assembly 4 is relatively small and does not damage the rail 32 in a long term of use, which elongates the service life of the rail 32. The penetrating hole 415 may be also of a square shape.

Referring to FIGS. 8 and 9, during a cutting work, with the lock protrusion 452 engaged in the upper lock hole 427, a counteracting force generated as a result of cutting, which might act on the spindle member 431 and a recessed wall of the recess 432, is received by the lock protrusion 452, thereby elongating the service life of the spindle member 431 and the recessed wall of the recess 432. Besides, with the engaging ribs 451 engaged in the elongated grooves 416, the connection between the lock cap 45 and the top block 411 can be enhanced so as to prevent breaking of the lock cap 45 at a pivot 47 from the top block 411. It should be noted that the rotary trimmer assembly 4 may be used for performing a cutting work without the base 3.

As illustrated, the blade holder 42 can hold a plurality of cutting blades 4221, 4222, 4223, 4224 which can provide different cutting functions, and the cutting blades can be shifted by rotating the operating member 423 without the need to remove the cutting blade previously in use from the holding seat 421, which is convenient to the user. With the retaining member 433 which is kept in the retaining position by means of the biasing member 434, the selected cutting blade 4221, 4222, 4223, 4224 can be easily retained in the cutting position.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A rotary trimmer assembly used with a working plane, comprising:

a housing having a top block which has a lower inclined wall facing and inclined relative to the working plane, and a surrounding wall which extends downwardly from a periphery of said top block and which cooperates with said lower inclined wall to define an accommodation space with a lower opening, and defining an axis which is normal to said lower inclined wall and which intersects the working plane by an acute angle;

a blade holder coupled with and rotatable relative to said lower inclined wall about the axis, said blade holder having a holding seat which is accommodated in said accommodation space to be spaced apart from said lower inclined wall and which has at least one holding wall that is inclined relative to the axis, at least one cutting blade which is rotatably mounted on said holding wall, and an operating member which is disposed in said accommodation space, which surrounds the axis to have a handle portion projecting outwardly of said surrounding wall, and which is connected with said holding seat such that said cutting blade is shiftable, by rotation of said blade holder relative to said lower inclined wall about the axis, between a cutting position, where said cutting blade is adjacent to and extends vertically to the working plane and has a cutting edge projecting outwardly of said lower opening, and a non-cutting position, where said cutting blade is remote from and inclined to the working plane and is accommodated in said accommodation space; and a retaining unit disposed between said lower inclined wall and said holding seat, and having a spindle member which extends along the axis from said lower inclined wall such that said blade holder is sleeved rotatably around said spindle member, a retaining member which is interposed between said lower inclined wall and said holding seat and which is movable in a direction of the axis between a retaining position, where said lower inclined wall is retained to said holding seat to prevent rotation of said holding seat, and a non-retaining position, where the rotation of said holding seat is permitted, and a biasing member which is disposed to bias said retaining member to the retaining position.

2. The rotary trimmer assembly as claimed in claim 1, wherein said blade holder has a recess extending in the direction of the axis for insertion of said spindle member thereinto, and terminating at a retaining wall which faces said lower inclined wall and which has a plurality of grooves that are angularly displaced from each other about the axis, said retaining member having a retained wall which has a plurality of teeth that are angularly displaced from each other about the axis and that are disposed to engage said grooves in the retaining position.

3. The rotary trimmer assembly as claimed in claim 2, wherein said spindle member has a female threaded portion, said retaining unit further having a male threaded member which is threadedly engaged with said female threaded portion so as to keep said biasing member and said retaining member coaxial with each other along the axis, said retaining member being in a spine engagement with said spindle member.

4. The rotary trimmer assembly as claimed in claim 1, wherein said surrounding wall of said housing has a lateral opening formed therethrough for projection of said handle portion of said operating member, said operating member having at least one upper lock hole opened upwardly, said top block having at least one elongated groove extending to communicate with said lateral opening, said rotary trimmer assembly further comprising a lock cap which is pivotably connected to said top block at a lateral end thereof and which extends to cap said top block and to terminate at a lock protrusion, said lock cap having at least one engaging rib formed on an inner wall and adjacent to said lock protrusion such that said lock cap is turnable between a locking position, where said engaging rib is engaged in said elongated groove and said lock protrusion is retained in said upper lock hole so as to prevent the rotation of said blade holder, and an unlocking position, where said engaging rib is disengaged from said elongated groove and said lock protrusion is disengaged from said upper lock hole to permit the rotation of said blade holder.

5. The rotary trimmer assembly as claimed in claim 1, further comprising a stand leg which is disposed on said surrounding wall at a side opposite to said handle portion of said operating member and which is adapted to stand on the working plane so as to keep the axis intersecting the working plane by the acute angle.

6. The rotary trimmer assembly as claimed in claim 1, wherein said cutting blade is in a form of a wheel which is rotatably mounted on said holding wall through a pivot member and which has a rim serving as said cutting edge.

7. The rotary trimmer assembly as claimed in claim 1, wherein said holding seat is in a form of a frusto-square pyramid to have four of said holding walls angularly displaced from each other about the axis, said blade holder having four of said cutting blades respectively and rotatably mounted on said holding walls, said operating member having four upper lock holes which are respectively formed above said holding walls such that when one of said cutting blades is retained in the cutting position, three other ones of said cutting blades are in the non-cutting position.

8. The rotary trimmer assembly as claimed in claim 7, wherein said surrounding wall of said housing has a lateral opening formed therethrough for projection of said handle portion of said operating member, said top block having a pair of elongated grooves extending to communicate with said lateral opening, said rotary trimmer assembly further comprising a lock cap which is pivotably connected to said top block at a lateral end thereof and which extends to cap said top block and to terminate at a lock protrusion, said lock cap having a pair of engaging ribs formed on an inner wall and adjacent to said lock protrusion such that said lock cap is turnable between a locking position, where said engaging ribs are respectively engaged in said elongated grooves and said lock protrusion is retained in said upper lock hole so as to prevent the rotation of said blade holder, and an unlocking position, where said engaging ribs are respectively disengaged from said elongated grooves and said lock protrusion is disengaged from said upper lock hole to permit the rotation of said blade holder.

9. A rotary trimmer device comprising:

a base having a working plane and a rail extending over said working plane; and a rotary trimmer assembly as claimed in claim 1, which is slidably connected with said rail, wherein said top block of said housing has a penetrating hole configured to be fittingly engaged with said rail to permit said housing to be slidable on said rail.

10. The rotary trimmer device as claimed in claim 9, wherein said rail has a cross-section of a parallelogram such that said rail has a bottom wall which intersects said working plane by an acute angle.

* * * * *